US010604708B2

(12) United States Patent
Butley et al.

(10) Patent No.: US 10,604,708 B2
(45) Date of Patent: Mar. 31, 2020

(54) PROCESS INTENSIFICATION IN HYDROPROCESSING

(71) Applicant: INDIAN OIL CORPORATION LIMITED, Mumbai (IN)

(72) Inventors: Ganesh Vitthalrao Butley, Faridabad (IN); Yamini Gupta, Faridabad (IN); Mainak Sarkar, Faridabad (IN); Arun Arangarasu, Faridabad (IN); Madhusudan Sau, Faridabad (IN); Brijesh Kumar, Faridabad (IN); Santanam Rajagopal, Faridabad (IN); Ravinder Kumar Malhotra, Faridabad (IN)

(73) Assignee: INDIAN OIL CORPORATION LIMITED, Mumbai (IN)

( * ) Notice: Subject to any disclaimer, the term of this patent is extended or adjusted under 35 U.S.C. 154(b) by 169 days.

(21) Appl. No.: 15/912,212

(22) Filed: Mar. 5, 2018

(65) Prior Publication Data

US 2018/0195012 A1 Jul. 12, 2018

Related U.S. Application Data

(63) Continuation of application No. 14/313,783, filed on Jun. 24, 2014, now Pat. No. 10,017,703.

(30) Foreign Application Priority Data

Jun. 25, 2013 (IN) ..... 2162/MUM/2013

(51) Int. Cl.
*C10G 65/04* (2006.01)

(52) U.S. Cl.
CPC ..... *C10G 65/04* (2013.01); *C10G 2300/202* (2013.01)

(58) Field of Classification Search
CPC ..... C10G 65/04; C10G 2300/202
See application file for complete search history.

(56) References Cited

U.S. PATENT DOCUMENTS

| | | | | |
|---|---|---|---|---|
| 3,239,454 | A | 3/1966 | Streed | |
| 5,705,052 | A | 1/1998 | Gupta | |
| 6,123,835 | A | 9/2000 | Ackerson et al. | |
| 6,328,879 | B1 | 12/2001 | Kalnes | |
| 6,797,154 | B2 | 9/2004 | Mukherjee et al. | |
| 6,881,326 | B2 | 4/2005 | Ackerson et al. | |
| 7,238,274 | B2 | 7/2007 | Turner | |
| 7,238,275 | B2 | 7/2007 | Stupin et al. | |
| 7,419,582 | B1 * | 9/2008 | Hoehn ..... | C10G 65/12 208/103 |
| 7,790,020 | B2 | 9/2010 | Kokayeff et al. | |
| 7,794,585 | B2 | 9/2010 | Leonard et al. | |
| 7,794,588 | B2 | 9/2010 | Kokayeff et al. | |
| 7,799,208 | B2 | 9/2010 | Kokayeff et al. | |
| 7,842,180 | B1 | 11/2010 | Leonard et al. | |
| 2003/0205504 | A1 * | 11/2003 | Kaminsky ..... | C10G 65/12 208/210 |
| 2004/0251169 | A1 | 12/2004 | Breivik et al. | |
| 2006/0131212 | A1 | 6/2006 | Dahlberg et al. | |
| 2016/0053183 | A1 * | 2/2016 | Eizenga ..... | C10G 3/50 585/253 |

* cited by examiner

*Primary Examiner* — Randy Boyer
(74) *Attorney, Agent, or Firm* — Maschoff Brennan

(57) ABSTRACT

A multi-stage hydrotreating process obtains ultra-low sulfur diesel boiling range hydrocarbon having less than 10 ppm sulfur with elimination of external hot high pressure separator and avoids the formation of recombinant mercaptans by removing excess hydrogen sulfide formed during hydroprocessing reaction. The process includes mixing a diesel boiling range hydrocarbon feedstock with hydrogen and sending to the first predominantly liquid phase hydroprocessing reaction stage. Effluent from the first hydroprocessing reaction stage is sent to first separator zone of open and empty space in the upper part of the second hydroprocessing reaction stage to flash off the dissolved reaction products hydrogen sulfide and ammonia. Liquid part of the effluent of first hydroprocessing reaction stage is passed to the second predominantly liquid phase hydroprocessing reaction stage. The process is repeated until the liquid product sulfur level of less than 10 ppm is attained and the liquid product is sent to further processing.

10 Claims, 3 Drawing Sheets

PROCESS INTENSIFICATION IN HYDROPROCESSING

CROSS-REFERENCE TO RELATED APPLICATIONS

This application is a Continuation of U.S. application Ser. No. 14/313,783, filed Jun. 24, 2014 which claims priority to Indian Patent Application No. 2162/MUM/2013 filed on Jun. 25, 2013. The foregoing patent applications are incorporated herein by reference.

FIELD OF THE INVENTION

The invention is related to obtaining ultra low sulfur diesel in hydroprocessing. The invention also related to carrying out the hydroprocessing reaction in liquid phase in multitude of stages.

BACKGROUND OF THE INVENTION

Fossil fuels will remain the major source of energy for many years to come. Diesel fuels form the major chunk of fossil fuels. Globally the demand pattern of fuel indicates that it is shifting towards diesel even in those countries where the traditionally gasoline was dominant fuel. Increasing environmental concerns and climatic awareness made the diesel specifications tighter and tighter with respect to sulfur and cetane for controlling vehicular emissions. Due to tighter sulfur specifications, the sulfur levels in diesel fuel is going down, very soon 10 ppm sulfur diesel fuel will be a worldwide norm.

Hydroprocessing is the most generally used process to achieve these specifications in refineries today. It involves subjecting a hydrocarbon feedstock along with hydrogen gas under catalytic processing at high temperature and pressure conditions suitable to achieve the product specifications. The process generally can be classified in two major classes, first one is hydrotreating, where there is no major change in molecular weight of feedstock occurs, only heteroatoms such as those related to emission norms e.g. sulfur content and those heteroatoms which may hinder removal of these atoms e.g. nitrogen are mainly removed. In addition to this removal of heteroatoms from organic molecules some minor changes in molecules are also obtained in order to achieve other specifications such as cetane number. These changes involves the mainly saturation of aromatic molecules to respective naphthenes. The second class of hydroprocessing is the hydrocracking, where there is conversion by means of cracking of heavy molecules to lighter (more usable) molecules in presence of high hydrogen pressures. The catalysts also differ in two processes owing to their duties to be performed. In hydrotreating the catalyst involved is having only metal function on inert support and in hydrocracking the metal function is supported on acidic support rather than inert support, which additionally gives cracking activity to the catalyst.

There are other types of processes which are emerging or being practiced to achieve the abovementioned goals of product fuel specifications, such as FCC for catalytic conversion of heavier molecules to lighter ones and oxidative desulfurization processes to achieve sulfur specifications. But all these processes can achieve only one of the specifications; for example, FCC can convert the heavier molecules to lighter ones but the products from which need again to be treated for heteroatom removal and cetane specifications in case of diesel. The oxidative desulfurization process may meet the sulfur specification but not cetane number. Therefore, hydroprocessing will be the only way to achieve all the product fuel specifications. The hydroprocessing thus have emerged as major important process in refining field, second only to crude distillation.

The desulfurization & cetane improvement of diesel boiling range hydrocarbon in hydrotreating process is achieved by reacting with hydrogen in presence of catalyst at high temperatures and high pressures. Extensive amount of work is being done to increase the effectiveness of the hydroprocessing to achieve desired product specifications with economical considerations. The developments are being done in the various areas of catalysis, process design and equipment designs. Various processing schemes are also being suggested to increase the effectiveness of hydroprocessing.

Gupta in U.S. Pat. No. 5,705,052 described a configuration of hydroprocessing which comprises achieving the two or more reaction stages in a single reaction vessel with hydrogen being circulated from last reaction stage to first reaction stage. The inter-stage gas and liquid separation along with liquid stripping is done in external vessel which again act a multistage liquid stripper but all the gases combined and recycled to last reaction stage.

Ackerson et. al. in U.S. Pat. Nos. 6,123,835 & 6,881,326 described a liquid phase hydroprocessing where need to circulate hydrogen through catalyst is eliminated. The hydrocarbon feedstock is presaturated and fed to the catalyst bed. The hydrogen required is supplied in dissolved form only. The solubility of feedstock is enhanced with the addition of dilution solvent which can be product of the process itself.

Turner in U.S. Pat. No. 7,238,274 and Stupin et. al. in U.S. Pat. No. 7,238,275 invented an integrated hydrotreating process for two feedstocks of different boiling range. The configuration involves mixing of vapor part of effluent of heavier feedstock hydrotreating reactor ($1^{st}$) with portion of lighter feedstock and hydrotreating in second reactor and separating the vapor part and recycling the same after make up to first hydrotreating reactor.

Leonard et. al. in U.S. Pat. No. 7,842,180 suggested a innovative scheme for hydrocracking process where a effluent of hydrocracking reactor is mixed with fresh feed and hydrogen at low concentration and treated in hydrotreating reactor; the effluent of which is cooled and fractionated and unconverted oil along with low hydrogen flow goes to hydrocracking reactor.

Leonard et. al. in U.S. Pat. No. 7,794,585 gave a method of hydroprocessing hydrocarbon streams, involving configuration of firstly directing hydrocarbonaceous feedstock to a first substantially liquid phase hydroprocessing (hydrotreating) zone and the effluent from the first substantially liquid phase hydrotreating zone to a second substantially liquid phase hydroprocessing (hydrocracking) zone generally undiluted with other hydrocarbon streams and then recycling a liquid portion of hydrocracking which preferably includes an amount of dissolved hydrogen therein to the hydrotreating zone.

Kokayeff et. al. in U.S. Pat. No. 7,794,588 described a process for producing ULSD having reduced polyaromatics with the configuration of firstly desulfurization at low pressure to obtain ULSD with minimum saturation of aromatics and then saturation of polyaromatics at high pressure with very low hydrogen rates without liquid recycle and without dilution with solvent, etc.

Kokayeff et. al. in U.S. Pat. No. 7,799,208 described a hydrocracking process having first gas phase continuous hydrotreating and then separating the hydrotreater effluent in gas and one or more liquid portions. Combining one or more liquid portions or bottom portion from separator with low hydrogen and passing the mixture in continuous liquid phase form (with fine hydrogen bubbles) to hydrocracker reactor and combining the hydrocracker effluent with hydrotreater effluent without liquid recycle and without dilution with solvent, etc.

Kokayeff et. al. in U.S. Pat. No. 7,790,020 gave a process for producing ULSD having higher cetane number, the configuration involves: firstly desulfurization at low pressure (48 barg) to obtain ULSD with minimum saturation of aromatics and then saturation of aromatics at high pressure (69 barg) with very low hydrogen rates without liquid recycle and without dilution with solvent, etc.

Kalnes in U.S. Pat. No. 6,328,879 described a process for simultaneous hydroprocessing of two feedstocks where first hydrocarbon feed (heavy) is contacted with hydrogen in hydrocracker, the effluent from which is separated/stripped in gas and liquid. The portion of this liquid is recycled to hydrocracker and a second hydrocarbon feed (lighter than first) is introduced in separator/stripper as reflux. The gas from separator/stripper is passed to post-treat hydrotreater for aromatics saturation and recycling the portion of gas from the post-treat hydrotreater to hydrocracker It may suffice to say that in spite of extensive amount of research work already available in the art, there are scopes for continuous improvement of the hydroprocessing. The prior art available suffers from the disadvantage of not addressing the issue of formation of recombinant mercaptans towards end regions of hydroprocessing whether it is hydrotreating or hydrocracking, while attempting to obtain ultra low sulfur diesel levels of less than 10 ppm, this issue becomes of prime importance. Further, though there are various schemes available for multistage reaction in hydroprocessing, but they either suffer from the disadvantage of cost intensiveness or complexity of designs and operability. The proposed invention is an attempt to overcome these shortcomings in the present art of hydroprocessing scheme.

SUMMARY OF THE INVENTION

Accordingly the present invention provides a multi-stage system for decreasing sulphur content in a liquid hydrocarbon feed, comprising: a first stage hydroprocessing reactor (230) adapted to receive preheated liquid hydrocarbon feed and hydrogen and produce an effluent; and one or more further stage hydroprocessing reactor (240) adapted to receive an effluent from a previous stage hydroprocessing reactor and produce an effluent comprising substantially reduced quantity of sulphur; wherein at least one of the one or more further stage hydroprocessing reactors being an integrated hydroprocessing reactor, the integrated hydroprocessing reactor defining a gas withdrawal zone, a separator zone, a liquid zone and an effluent withdrawal zone in a top to bottom fashion; the liquid zone comprising a catalyst bed; and the integrated hydroprocessing reactor being adapted to receive the effluent from a previous stage hydroprocessing reactor at about the liquid zone, effect separation of the effluent into a gaseous material and a liquid material in the separator zone, effect contacting of the liquid material thus separated with the catalyst bed in the liquid zone to obtain a current stage effluent, withdraw the current stage effluent from the effluent withdrawal zone and withdraw the gaseous material thus separated from the gas withdrawing zone. The present invention also provides a multi-stage process for decreasing sulphur content in a liquid hydrocarbon feed comprising the steps of: providing a preheated liquid hydrocarbon feed and hydrogen to a first stage hydroprocessing reactor to obtain an effluent; passing a previous stage effluent to one of the one or more further stage hydroprocessing reactor wherein at least one of the one or more further stage being an integrated hydroprocessing reactor defining a gas withdrawal zone, a separator zone, a liquid zone and an effluent withdrawal zone in a top to bottom fashion, the liquid zone comprising a catalyst bed, the previous stage effluent being provided at about the liquid zone: (a separation of the previous stage effluent into a gaseous material and a liquid material in the separator zone; and b) contacting of the liquid material thus separated with the catalyst bed in the liquid zone to obtain a further stage effluent; and c) withdrawing the gaseous material thus separated from the gas withdrawing zone and the further stage effluent from the effluent withdrawal zone such that the further stage effluent comprises substantially reduced quantity of sulphur content.

In an embodiment of the present invention, a heat exchanger is located below a previous stage and a further stage hydroprocessing reactor.

In a further embodiment of the present invention, the integrated hydroprocessing reactor is provided with a pressure control valve (PCV-1) to control the pressure of the gas withdrawal zone.

In an another embodiment of the present invention, the catalyst bed is provided with one or more hydrogen injection means.

In a still another embodiment of the present invention, the catalyst bed is provided with one or more hydrogen injection means.

In yet another embodiment of the present invention, the integrated hydroprocessing reactor is provided with liquid control valve (LCV-1) to maintain a predetermined level of liquid in the liquid zone.

In another embodiment of the present invention, the effluent from the previous hydroprocessing reaction stage is cooled to remove the heat of reaction before sending it to a further stage hydroprocessing.

In an embodiment the present invention, hydrogen to hydroprocessing liquid feed concentration is 10 to 1000% excess of stoichiometrically required amount.

In an embodiment the present invention, the catalyst bed is maintained at a temperature of 250 to 400° C. and pressure in range of 2.0 to 10.0 MPa.

In a further embodiment of the present invention, the liquid level is maintained in integrated hydroprocessing reactor is 200 mm to 1000 mm above to topmost catalyst layer of topmost catalyst bed.

In an another embodiment of the present invention, the diesel boiling range hydrocarbon feedstock is having the boiling range between 125 to 400° C. having sulfur concentration preferably in the range of 0.5 to 3.0 wt %.

In yet another embodiment of the present invention, the liquid hourly space velocity of hydrocarbon feedstock with respect to catalyst bed is maintained in the range of 0.4 to 8 $h^{-1}$.

DETAILED DESCRIPTION OF THE INVENTION

Figure 1:
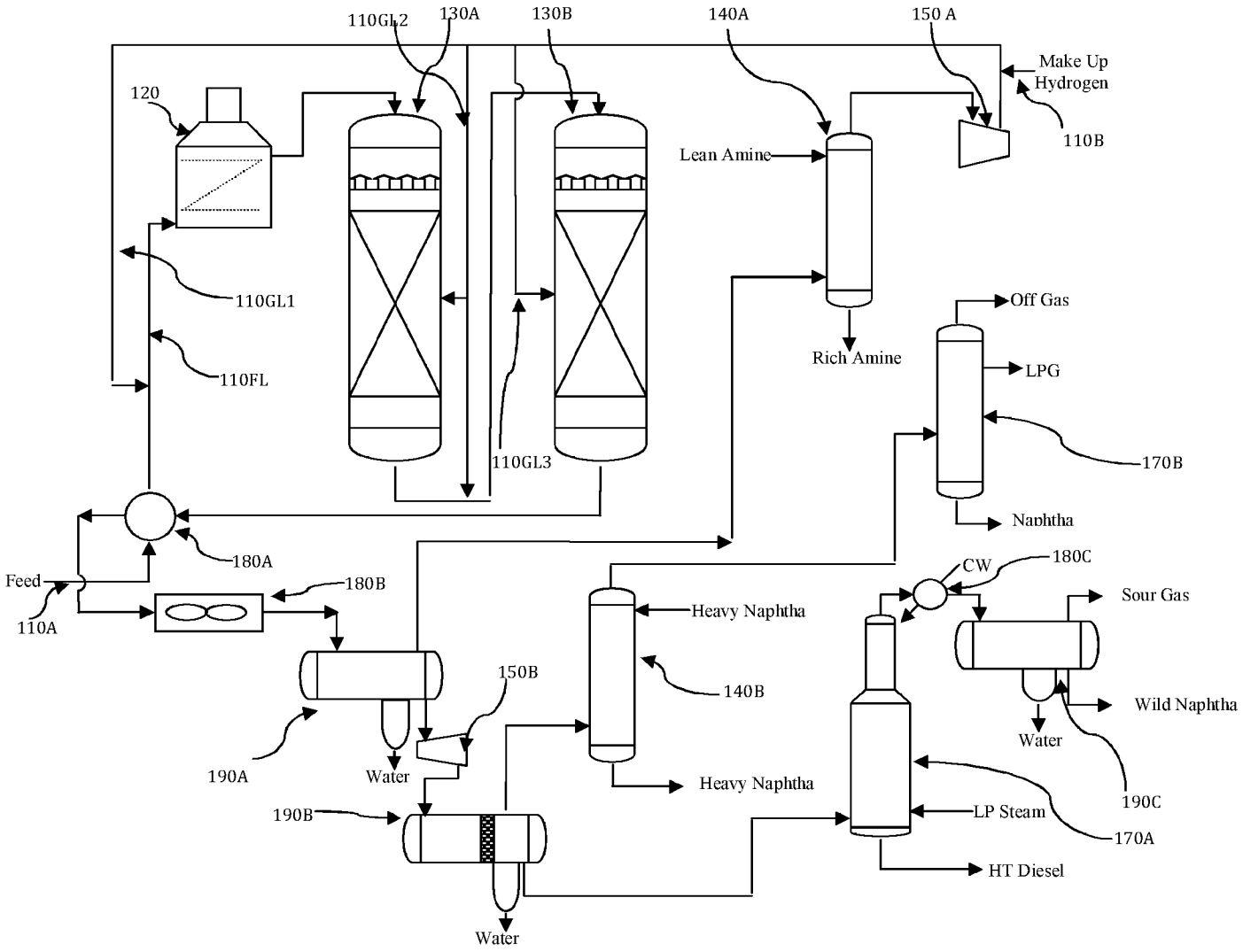
Figure-1 Prior Art
FIG. 1 is a schematic view of an exemplary configuration of a prior art hydrotreating plant.

The present invention provides the innovative process for intensification configuration scheme of hydrotreatment of diesel under predominantly liquid phase conditions provides the multitude of zones of hydrotreatment to produce ultra low sulfur diesel range boiling hydrocarbon stream with means of making up continuously depleting hydrogen concentrations levels in predominantly liquid phase diesel boiling range hydrocarbon stream and with means of reducing the levels of concentrations of reaction products such as hydrogen sulfide, etc. for avoiding the formation of recombinant mercaptans. The process intensification is achieved by means of elimination of external hot high pressure gas and liquid effluent separator for multitude of hydrotreating zones.

In the present invention hydrocarbon feed stock of diesel boiling range hydrocarbon is subjected to multiple hydrotreating zones to produce a hydrocarbon product having ultra low sulfur, i.e. less than 10 ppm under predominantly liquid phase conditions in which hydrogen is supplied in mainly dissolved form. The hydrogen supplied is in excess to that required stoichiometrically. However, along the course of reaction, the reaction products form mainly hydrogen sulfide and ammonia and hydrogen get continuously depleted due to hydrotreating reactions namely hydrodesulfurization, hydrodenitrogenation and hydrodearomatization, etc. These reaction products are known as hindrance to the hydrotreating reactions. With continuous increase concentration of hydrogen sulfide and as the temperature of reaction increases along the flow path of reactants, there are chances of formation of recombinant mercaptans. Therefore, the means of removing these reaction products such as hydrogen sulfide are provided along the flow path of reactants in multitude of hydrotreating reaction zones. These means of reducing the levels of the reaction products are provided in the form of zones which allow the separation of these reaction products from the liquid phase diesel boiling range hydrocarbon undergoing hydrotreatment.

Due to removal of reaction products such as hydrogen sulfide, ammonia, etc. the number of stages of contacting of reactants and reaction increases. The means of making up of continuously depleting hydrogen concentration levels in predominantly liquid phase diesel hydrocarbon stream are provided. In the present invention, means are provided to remove residual hydrocarbons from the stream of gaseous products such as hydrogen sulfide, ammonia, etc.

The present invention includes one important aspect of eliminating highly cost intensive separate external hot high pressure separator required for imparting effect of multitude stages to knock off residual gases before sending the product hydrocarbon stream to low pressure separator.

In the present invention due to separation of reaction hindrance causing molecules such as hydrogen sulfide and ammonia and at the same time making up of consumed dissolved hydrogen concentration levels the requirement of volumes catalyst bed and hence the reactor volumes of second and subsequent stages is less as compared to the prior art. It is also apparent in the present invention that no recycle of product or dilution with solvent is required to supply the hydrogen requirements of hydroprocessing reactions, since hydrogen is supplied in such a way that there is no depletion in hydrogen concentrations anywhere in given hydroprocessing reaction stage or any of the hydroprocessing reaction stage.

In one aspect of the present invention, the requirement of post-treat bed to remove recombinant mercaptans is obviously eliminated.

The desulfurization of diesel boiling range hydrocarbon in hydrotreating process is achieved by reacting with hydrogen in presence of catalyst at high temperatures and high pressures. The mechanism involves major steps of transfer of sulfur atom by breakage metal-sulfur bond in catalyst to hydrogen forming hydrogen sulfide followed by transfer of sulfur atom from organic molecule in diesel boiling range hydrocarbon by breakage of carbon-sulfur bond and the cycle goes on. Therefore, the concentration of hydrogen sulfide keeps on increasing with the course of reaction. In this mechanism net heat is released upon completion of whole cycle, therefore the reaction is exothermic in nature. This causes the temperature to increase as the reaction proceeds along the flow path of reactants which are hydrogen and diesel boiling range hydrocarbon over the catalyst bed in hydrotreating zones. Towards the end of hydrotreating zones this temperature can increase up to 420 to 430° C. in localized regions in catalyst bed and generally called hot spots. This increased temperature causes some inevitable side reactions of thermal cracking giving rise to formation of olefins in appreciable quantities. The phenomenon is more predominant towards the end of reactor. With the presence of hydrogen sulfide in substantial concentrations, these olefins lead to the formation of mercaptans and are called recombinant mercaptans.

Conventionally, these recombinant mercaptans are removed by giving extra volume of post-treat hydrotreating catalyst at the end of reactor. Still, if the catalyst bed temperatures are high enough, the formation of recombinant mercaptans cannot be avoided even if they are in trace quantities. The issue becomes of significant importance while hydrotreaters are being designed for obtaining the ultra low sulfur levels of less than 10 ppm.

Still more important, the hydrotreating of diesel boiling range hydrocarbon are generally carried out in single stage configuration (with once-through liquid hydrocarbon). That is to say, there is no separation of reaction products midway from start to the end of hydrotreating reaction zone. This is because of the requirement of very high pressure gas and liquid separators that are required to be operated at high temperatures as well to achieve the midway or intermittent separations of reaction products (e.g. hydrogen sulfide) from rest of the reactants and products. The option of installing high pressure separator is generally avoided because of obvious reasons of cost intensiveness of such a high pressure vessels.

Further, the presence of some quantity of hydrogen sulfide is required from the process point of view, because the catalysts those are generally used in the hydrotreating reaction mechanisms are usually active in sulfided form only. Therefore, presence of hydrogen sulfide is must to keep the catalyst in active form throughout the hydrotreating reaction zone for entire catalyst life cycle.

This dual contrasting requirement of keeping hydrogen sulfide present in reaction medium along and at the same time reducing the excess concentrations below the levels of formation of recombinant mercaptans is the need of the process. Additionally, removal of hydrogen sulfide, ammonia and other gases midway during the course of hydrotreating reactions also gives the effect of multitude of stages of contacting of reactants and the effect of multitude of reaction stages. Both these requirement are necessary for achieving the ultra low sulfur diesel of less than 10 ppm in hydrotreaters. Present invention is aimed at fulfilling these requirements of achieving the ultra low sulfur of less than 10 ppm diesel in hydrotreating.

The innovative configuration scheme of hydrotreatment of diesel is under predominantly liquid phase conditions and also provide the multitude of stages of hydrotreatment to produce ultra low sulfur diesel range boiling hydrocarbon stream and with means of making up continuously depleting hydrogen concentrations levels in predominantly liquid phase diesel boiling range hydrocarbon stream and with means of reducing the levels of concentrations of reaction products such as hydrogen sulfide, etc. for avoiding the formation of recombinant mercaptans.

In one aspect of the present invention, the requirement of post-treat bed to remove recombinant mercaptans is obviously eliminated. This also results in still lower requirement of volume of catalyst bed than would be conventionally required.

In one embodiment of the present invention, hydrocarbon feed stock of diesel boiling range hydrocarbon is subjected to multiple i.e. two or more hydrotreating stages to produce a hydrocarbon product having ultra low sulfur, i.e. less than 10 ppm under predominantly liquid phase conditions in which hydrogen is supplied in mainly dissolved form. The feed diesel can be in the boiling range of 125 to 400° C. having densities of 0.75 to 0.92 g/cc with varying levels of aromatics, olefins, nitrogen, metals, etc. The typical sulfur content in diesel boiling range hydrocarbon feedstock can be between 0.5 to 3.0 wt %. It can be sourced directly from crude distillation or from processing units of thermal or catalytic cracking. The properties and sources mentioned here are, however, exemplary in nature and the said diesel can have other properties and sources not mentioned herein.

The diesel boiling range hydrocarbon feedstock is mixed with hydrogen 10 to 1000% excess to that required stoichiometrically and fed to the first reaction stage after appropriate heating. This excess hydrogen is supplied to make the reaction independent of hydrogen concentration and to maintain hydrogen concentration in first stage of hydroprocessing reaction so that there is no depletion occurs over entire length of catalyst beds in the reactor. However, alternatively two or more additional hydrogen injection points can be provided to maintain the excess hydrogen concentration up to 10 to 1000% excess to that required stoichiometrically.

Although the hydrogen supplied is in excess to that required stoichiometrically, however, along the course of reaction hydrogen get continuously depleted due to hydrotreating reactions namely hydrodesulfurization, hydrodenitrogenation and hydroderomatization, etc. and the reaction products are mainly hydrogen sulfide and ammonia. These reaction products are hindrance to the hydrotreating reactions. With continuous increase concentration of hydrogen sulfide and as the temperature of reaction increases, there are chances of formation of recombinant mercaptans. Therefore in another embodiment of the invention, means of removing these reaction products along the flow path of hydrotreating reaction are provided.

The hydroprocessing reaction effluent of first stage is first cooled somewhat to remove the heat of reaction of the first hydroprocessing reaction stage and sent to above said means which are provided in the form of first separation zone of open and empty space which allows little flashing of reaction effluent from first stage. The first separation zone of open and empty space allows the separation of hydrogen sulfide, ammonia and other gases and liquid product of first hydroprocessing reaction stage. Though, the operating pressure of the first separation zone is maintained almost equal to the hydroprocessing reaction effluent from first stage, the extent of flashing in said separation zone of open and empty space is controlled by slight variation in pressure in the said separation zone with help of pressure control valve. This allows the extent hydrogen sulfide that is needed to be left in the liquid product of first hydroprocessing reaction stage and rest is removed along with the gases from the effluent of first hydroprocessing reaction stage.

Due to reduction in concentration levels because of part removal of reaction products mainly hydrogen sulfide eliminates the chances of formation of recombinant mercaptans which is possible due to presence of trace amount of olefins being generated continuously due to side reactions of thermal cracking. At the same time some amount of hydrogen sulfides (near equilibrium) is left in the dissolved form in the liquid product of first reaction stage so that the hydroprocessing catalyst of the next hydroprocessing reaction stage does not get deactivated.

The recombinant mercaptan level obtained in the final product in the present innovative scheme is less than 0.5 ppm mercaptan, more preferably less than 0.1 ppm, still more preferably 0.05 ppm. In another embodiment of the present invention, the first separation zone of open and empty space is housed at top of the catalyst bed of the second hydroprocessing reaction stage. This inventive way of housing the first and subsequent separation zones, completely eliminates the need of external hot high pressure gas and liquid separator which is very cost intensive. Further, in the conventional hydroprocessing scheme for increasing number of stages one additional external hot gas liquid separator is required along with the reactor, but in present invention addition of one reactor is equivalent to increase in one additional stage.

The liquid product of first hydroprocessing reaction stage flows down over the catalyst bed of second hydroprocessing reaction stage such that this stage also operates predominantly in liquid phase. In another embodiment of the present invention, the means of making up of continuously depleting hydrogen concentration levels in predominantly liquid phase diesel hydrocarbon stream are provided. The hydrogen gas is injected at two or more locations along the length of second hydroprocessing reaction stage to make up for the reduction in concentration levels of dissolved hydrogen due to consumption in hydroprocessing reactions to maintain hydrogen concentration in excess up to 10 to 1000% than that required stoichiometrically. This excess hydrogen is supplied to make the reaction independent of hydrogen concentration and to maintain hydrogen concentration in first stage of hydroprocessing reaction so that there is no depletion occurs over entire length of catalyst beds in the second hydroprocessing reaction stage.

In one embodiment of the present invention, due to removal of reaction products such as hydrogen sulfide, ammonia, etc. before going to next hydroprocessing catalyst makes this next hydroprocessing reaction stage as second stage, because the hydrogen concentration that is available will be made up by fresh hydrogen injection and due to removal of reaction products such as hydrogen sulfide, the next hydroprocessing zone become the next contacting and reaction stage.

In yet another embodiment of present invention, means are provided to remove residual hydrocarbons from the stream of gaseous products such as hydrogen sulfide, ammonia, etc. The outgoing gases are made to pass through demister pads which are being kept wetted by down flowing liquid which is a small slip stream of liquid product of first hydroprocessing reaction stage and feed of the next hydroprocessing reaction stage. This down flowing liquid is spread uniformly over the demister pad by means of a pump specially allocated for the purpose. Such washing of outgoing gases at the top of first separation zone of open and empty space is provided to remove any entrained hydrocarbon liquid particles.

The effluent of second hydroprocessing reaction stage is sent to second separation zone of open and empty space under level control. The level in the first separation zone of open and empty space housed at the top of second hydroprocessing reaction stage is maintained by flow of effluent from the second hydroprocessing reaction stage, so that whole catalyst beds of second hydroprocessing reaction stage is predominantly filled with liquid phase.

The effluent of second hydroprocessing reaction stage is sent to second separation zone of open and empty space under level control but after appropriate cooling to remove the heat of reaction from the second hydroprocessing reaction stage. In second separation zone of open empty space, the dissolved gases such as hydrogen sulfide formed during second hydroprocessing reaction stage, etc. are knocked off as described earlier and the gases are washed before going to off gas stream. The liquid product of second hydroprocessing reaction stage is passed through the third hydroprocessing reaction stage operated in predominantly in liquid phase, which again may be provided with two or more hydrogen injection points as the means of making up reduced levels of hydrogen concentrations due to consumption in hydroprocessing reactions to maintain the excess hydrogen concentration up to 10 to 1000% excess to that required stoichiometrically. This excess hydrogen is supplied to make the reaction independent of hydrogen concentration and to maintain hydrogen concentration in first stage of hydroprocessing reaction so that there is no depletion occurs over entire length of catalyst beds in the third hydroprocessing reaction stage.

The liquid product of third hydroprocessing reaction stage can be sent to subsequent hydroprocessing reaction stage as described earlier through the third separation zone of open and empty space followed by hydroprocessing reaction zone if required. The ultra low sulfur diesel of less than 10 ppm for liquid reaction product is usually attained in the second hydroprocessing stage itself. If not attained third or subsequent reaction stages can be designed in similar manner.

It is also clear to those skilled in the art that in such a scheme of hydroprocessing, every hydroprocessing reaction stage can be made smaller and smaller to increase the number of hydroprocessing reaction stages to derive the benefits of multitude of reaction stages. Since in a proposed invention, any number of reaction stages can be designed without much increase in the capital cost due to elimination of separate external hot high pressure gas and liquid separator. Increasing number of stages by reducing every stage of smaller volume also has an added advantage of ease of removal of heat of exotherm.

In another embodiment of the invention, due to separation of reaction hindrance causing molecules such as hydrogen sulfide and ammonia and at the same time making up of consumed dissolved hydrogen concentration levels, the requirement of volumes catalyst bed and hence the reactor volumes of second and subsequent stages is less as compared to the prior art. It is also apparent in the present invention that no recycle of product or dilution with solvent is required to supply the hydrogen requirements of hydroprocessing reactions, since hydrogen is supplied in such a way that there is no depletion in hydrogen concentrations anywhere in given hydroprocessing reaction stage or any of the hydroprocessing reaction stage.

It is known to those skilled in the art that any hydroprocessing scheme if operated in multitude of stages the temperature required for obtaining a particular given conversion level is less when compared to when operated in once-through mode. This advantage is inherent to the proposed invention.

Each of the above said catalytic hydroprocessing reaction stage is operated in usual operating regime of hydrotreating, the temperatures may be in the range from 200 to 420° C. and the pressure may be in the range from 1.0 to 25.0 MPa and liquid hourly space velocities ranging from 0.1 to 16.0 $h^{-1}$. For a diesel boiling range hydrocarbon feedstock for obtaining ultra low sulfur diesel with latest generation of hydrotreating catalysts in the proposed invention, the temperature range is 250 to 400° C. and pressure range is 2.0 to 10.0 MPa and liquid hourly space velocities ranging from 0.4 to 8.0 $h^{-1}$. The catalysts that can be used in the present invention is any latest generation hydrotreating catalyst of molybdenum or tungsten promoted by cobalt or nickel and phosphorous, boron can be further assisting the activity enhancement of hydrotreating catalysts of molybdenum or tungsten promoted by cobalt or nickel.

The typical stoichiometric hydrogen consumptions requirements for obtaining an ultra low sulfur of less than 10 ppm for diesel boiling range hydrocarbon fuel from diesel boiling range hydrocarbon feedstock are 0.6 to 2.0 wt %. Therefore, if there are two reaction stages each with at least three injection points for hydrogen gas injection, then to make up for hydrogen concentration depletion then at every point approximately 0.08 to 0.30 wt % (of diesel boiling range hydrocarbon feedstock) hydrogen is needed to be given to maintain the hydrogen concentration levels in sufficient excess amount to that of stoichiometric requirement.

It may be clear to those skilled in the art that with increase in number of stages by way of proposed invention other properties of diesel boiling range hydrocarbon fuel such as cetane number are also greatly improved.

It is also clear to those skilled in the art that in place of diesel boiling range hydrocarbon feedstock, any other feedstock can be used for the purpose obtaining less than 10 ppm sulfur in liquid product. The diesel boiling range hydrocarbon feedstock, can be any feedstock from any source, straight run or conversion units, it can be naphtha range hydrocarbon feedstock boiling in the range of C5 to 125° C., kerosene range hydrocarbon feedstock boiling in the range of 125 to 280° C., diesel range hydrocarbon feedstock boiling in the range of 125 to 400° C. or vacuum gas oil range hydrocarbon feedstock boiling in the range of 250 to 550° C. for the purpose of obtaining less than 10 ppm sulfur in liquid product.

DETAILED DESCRIPTION OF DRAWINGS

A commonly used hydroprocessing process where the sulphur and nitrogen contaminant from the diesel range stream is removed in the form of $H_2S$ and $NH_3$ is Diesel hydrodesulphurization process (DHDS).

Prior art FIG. 1 depicts a typical conventional configuration 100 for such plant. Here the liquid feed (e.g. diesel range stream) 110A is passed through a heater 120 and subsequently fed into a reactor 130A. Hydrogen is supplied into the reactor combined with liquid feed through 110 GL1 and separately through 110 GL2. The effluent of reactor 130A goes to reactor 130B. The hydrogen in the $2^{nd}$ reactor is added through 110 GL3. The effluent of $2^{nd}$ reactor containing product and un-reacted gas is then cooled and flushed in High pressure separator (HPS) 190A. In HPS, only the hydrogen (un-reacted) gets separated along with some quantity of $H_2S$ from rest of the product. The hydrogen then washed with amine in amine absorption column 140A for removing $H_2S$. The washed hydrogen then compressed to the system pressure in Recycle Gas compressor and recycle back to the reactor. The makeup hydrogen is added to the system through 110B. The liquid part of the HPS is sent to Low pressure separator (LPS) 190B after recovering its pressure energy in Power recovery turbine 150B. In LPS rest of the gases like C1 to C4 and dissolved hydrogen get separated from the liquid product. The gases are then sent to the gas recovery section, 170B after passing it through Sponge absorption column 140B. In sponge absorption column the gases containing the heavier condensable part is recovered. The liquid part from the LPS is then sent to Stripper, 170A where the liquid is stripped with steam to remove the dissolved $H_2S$ and naphtha (wild Naphtha) part from the diesel. The sweet diesel is then sent to storage.

Figure 2:
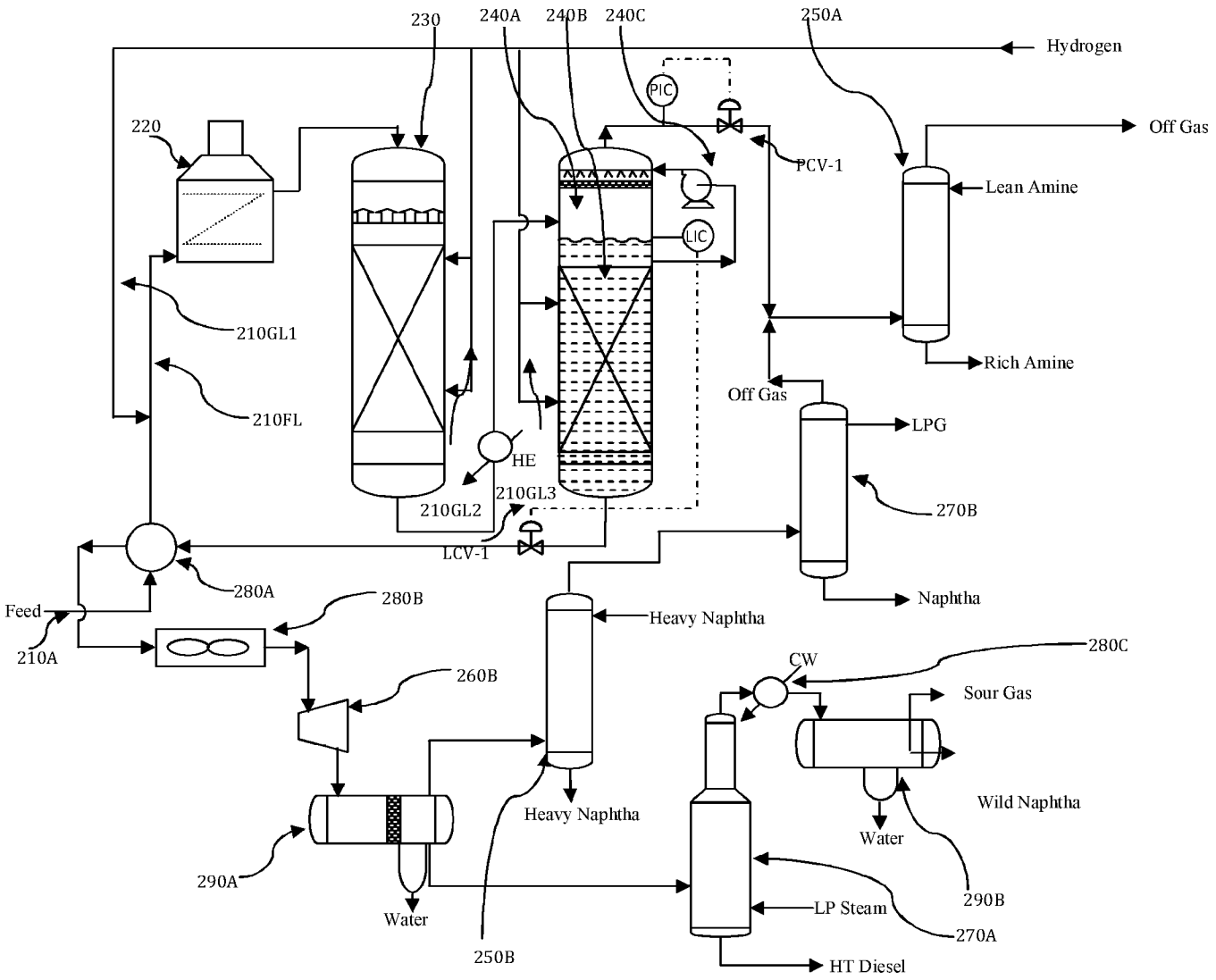
FIG. 2 is the schematic view of exemplary configuration of a hydroprocessing plant according to the proposed invention for two stages of hydroprocessing reaction

The innovative modification in hydroprocessing scheme is shown in FIG. 2 and a typical DHDS process is being explained for understanding the essence of the scheme. The nomenclatures of the equipments are done using 200 series. Here the liquid feed (diesel boiling range stream) 210A is passed through a heater 220 and fed to the first hydroprocessing reaction stage reactor 230. Hydrogen is supplied into the first hydroprocessing reaction stage reactor combined with liquid feed through 210 GL1 and separately in the first hydroprocessing reaction stage reactor through 210 GL2. Only slight excess of the calculated stoichiometric amount of hydrogen is supplied so the first hydroprocessing reaction stage reactor 230 operates predominantly in liquid phase. The effluent of first hydroprocessing reaction stage reactor 230 goes to $2^{nd}$ reactor 240, whose top part 240A is a High pressure separator zone (HPS) called first separation zone of open and empty space. The effluent of first hydroprocessing reaction stage reactor containing unconverted feed, product and un-reacted gas ($H_2$) is flashed in HPS 240A. Before flashing, the temperature of the effluent is cooled to required extent in heat exchanger HE by any available cooling media such as fresh feed which is being preheated. The pressure of the flashing zone (first hydroprocessing reaction stage reactor) is controlled by pressure control valve PCV-1. Here the gaseous part of the first hydroprocessing reaction stage reactor 230 effluent gets separated from the liquid part. The gaseous part of the first hydroprocessing reaction stage reactor effluent that gets separated from the liquid part, mainly comprises of reaction products like $H_2S$ and ammonia. The liquid part of the first hydroprocessing reaction stage reactor 230 effluent is the passed over the catalyst bed 240B of second hydroprocessing reaction stage reactor 240. Here further hydrotreating reactions take place and the unconverted in the feed gets converted to product. Second hydroprocessing reaction stage reactor 240B also operates predominantly in liquid phase. In second hydroprocessing reaction stage reactor 240B the hydrogen required for the hydroprocessing reaction will be available in soluble form and the liquid will be in the continuous phase in contrary to that in conventional hydroprocessing trickle bed reactor. A part of the liquid in HPS 240A is sprayed at top (over demister pad) for washing purpose. Depending on the chemical consumption in the reactor the hydrogen is added at different position along the length of the catalyst bed for making up the depletion of hydrogen through 210 GL3. The pure hydrogen is added to the system through 210B. The level of the second hydroprocessing reaction stage reactor 240 is maintained by a level control valve LCV-1. The level in the reactor 240 is so maintained that the catalyst bed 240B is always flooded with liquid. The second hydroprocessing reaction stage reactor 240 effluent is cooled in 280A, 280B and then flashed in Low pressure separator (LPS) 290A. Prior to flashing in 290A the pressure energy is recovered using Power recovery turbine 260B. In LPS 290A rest of the gases like $C_1$ to $C_4$, some parts of C5 and un-reacted hydrogen get separated from the liquid product. The gases are then sent to the gas recovery section, 270B after passing it through Sponge absorption column 250B. In sponge absorption column the gases containing the heaver condensable part is recovered. The liquid part from the LPS is then sent to Stripper, 270A where the liquid is stripped with steam to remove the dissolved $H_2S$ and naphtha (wild Naphtha) part from the diesel. The sweet diesel is then sent to storage. The gaseous effluent at the top of reactor 240, containing mainly $H_2$, $H_2S$ and ammonia is sent to Amine absorber column 250A along with off gas from 270B. Here in Amine absorber column 250A $H_2S$ is washed off and then off gas is sent to off gas header.

Figure 3:
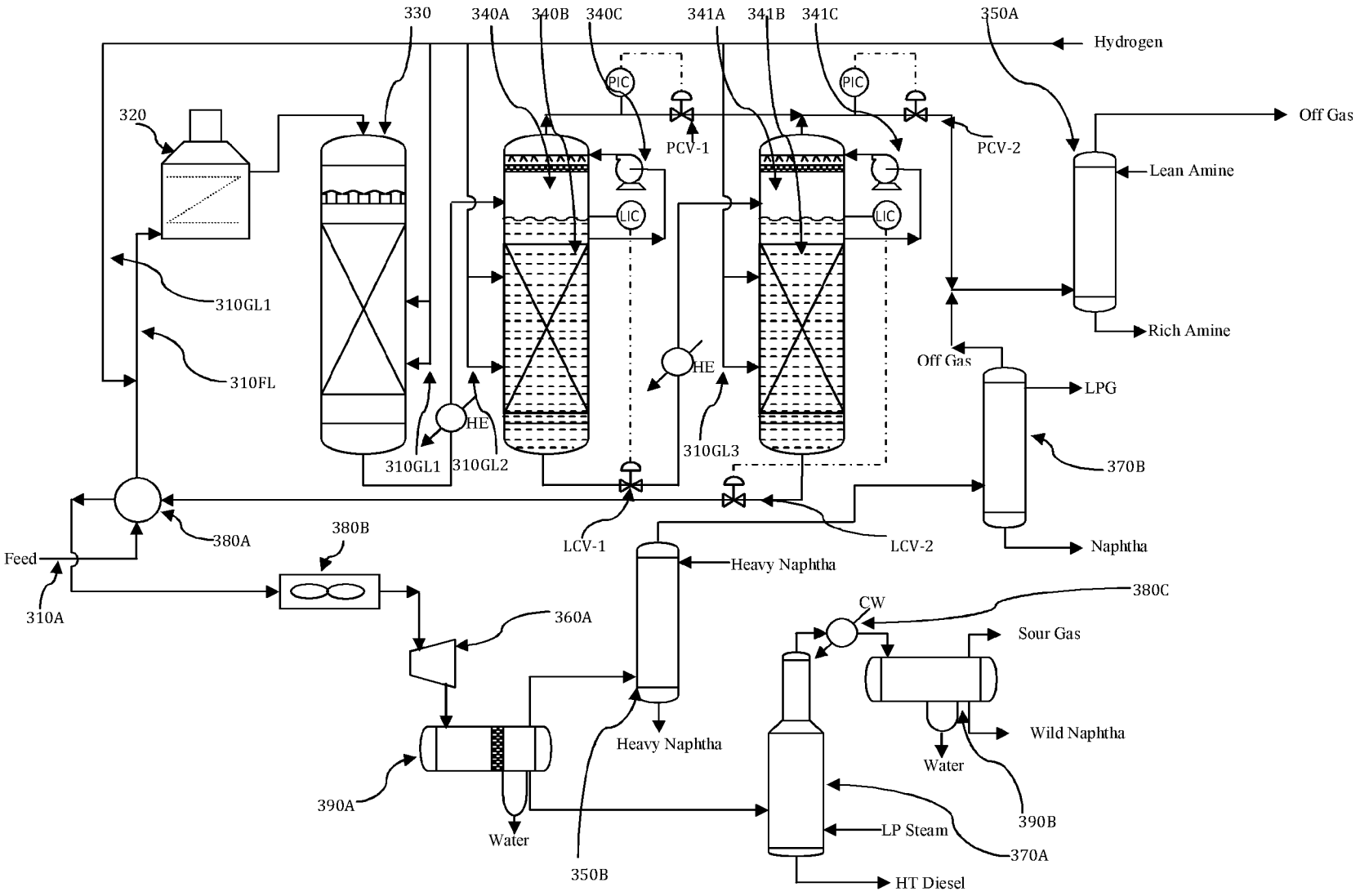
FIG. 3 is the schematic view of exemplary configuration of a hydroprocessing plant according to the proposed invention for three stages of hydroprocessing reaction

The FIG. 3 is the further extension of FIG. 2 for 3 reactor system where first and second hydroprocessing reaction stages 340 and 341 acts as both HPS and hydroprocessing reaction stage and both of them will act as a separate stage. Therefore, it is clear that with addition of every reactor one new stage is created and the process will be more and more efficient. Although, there will be increase in pressure drop in every stage but that can be taken care with adjustment of process parameters.

We claim:

1. A process combining functionality of High Pressure Separator (HPS) or Hot High Pressure Separator (HHPS) and Hydro-processing reactor and thereby introducing multi-staging effect within the reactor system itself for decreasing sulphur content in a liquid hydrocarbon feed comprising the steps of:

a. providing a preheated liquid hydrocarbon feed and hydrogen to a first stage hydroprocessing reactor to obtain an effluent;

b. passing a previous stage effluent to one of one or more further stage hydroprocessing reactor wherein at least one of the one or more further stage being an integrated hydroprocessing reactor defining a gas withdrawal zone, a separator zone, a liquid zone and an effluent withdrawal zone in a top to bottom fashion, the liquid zone comprising a catalyst bed, the previous stage effluent being provided at about the liquid zone:

i. separation of the previous stage effluent into a gaseous material and a liquid material in the separator zone; and ii. contacting of the liquid material thus separated with the catalyst bed in the liquid zone to obtain a further stage effluent; and iii. withdrawing the gaseous material thus separated from the gas withdrawal zone and the further stage effluent from the effluent withdrawal zone such that the further stage effluent comprises substantially reduced quantity of sulphur content avoiding the formation of recombinant mercaptan by way of removing hydrogen sulfide of hydroprocessing reaction products in excess to that required for keeping hydroprocessing catalyst in active sulfided form;

wherein, the integrated hydroprocessing reactor combines functionality of high pressure separator or hot high pressure separator and hydro-processing reactor and thereby only maintaining equilibrium $H_2S$ in the liquid by introducing multi-staging effect.

2. The process as claimed in claim 1, wherein the effluent from the previous hydroprocessing reaction stage is cooled to remove the heat of reaction before sending it to a further stage hydroprocessing.

3. The process as claimed in claim 1, wherein hydrogen to hydroprocessing liquid feed concentration is 10 to 1000% excess of stoichiometrically required amount.

4. The process as claimed in claim 1, wherein the catalyst bed is maintained at a temperature of 250 to 400° C. and pressure in range of 2.0 to 10.0 MPa.

5. The process as claimed in claim 1, where the liquid level is maintained in integrated hydroprocessing reactor is 200 mm to 1000 mm above to topmost catalyst layer of topmost catalyst bed.

6. The process as claimed in claim 1, wherein the diesel boiling range hydrocarbon feedstock is having the boiling range between 125 to 400° C. having sulfur concentration in the range of 0.5 to 3.0 wt %.

7. The process as claimed in claim 1, wherein the liquid hourly space velocity of hydrocarbon feedstock with respect to catalyst bed is maintained in the range of 0.4 to 8 $h^{-1}$.

8. The process as claimed in claim 1, wherein the concentration of hydrogen sulphide is maintained in the liquid hydrocarbon flowing over the catalyst bed in further stage hydroprocessing reactor to maintain the catalyst in sulfided form.

9. The process as claimed in claim 1, wherein hydrogen in injected at multiple locations along the length of the hydroprocessing reactor to maintain a concentration of hydrogen during the course of reaction.

10. The process as claimed in claim 1, wherein the liquid hydrocarbon feed is diesel boiling range hydrocarbon stream.

* * * * *